US012504249B2

(12) United States Patent
Lewin et al.

(10) Patent No.: US 12,504,249 B2
(45) Date of Patent: Dec. 23, 2025

(54) GUN MOUNT

(71) Applicant: BAE SYSTEMS PLC, London (GB)

(72) Inventors: Richard Peter Lewin, Cumbria (GB); Griffith Peter Andrew, Cumbria (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 18/700,567

(22) PCT Filed: Oct. 10, 2022

(86) PCT No.: PCT/GB2022/052557
§ 371 (c)(1),
(2) Date: Apr. 11, 2024

(87) PCT Pub. No.: WO2023/062346
PCT Pub. Date: Apr. 20, 2023

(65) Prior Publication Data

US 2025/0231000 A1 Jul. 17, 2025

(30) Foreign Application Priority Data

Oct. 11, 2021 (GB) ..... 2114472

(51) Int. Cl.
*F41A 23/24* (2006.01)
*F41A 23/34* (2006.01)

(52) U.S. Cl.
CPC ..... *F41A 23/24* (2013.01); *F41A 23/34* (2013.01)

(58) Field of Classification Search
CPC ..... F41A 23/00; F41A 23/005; F41A 23/18; F41A 23/24; F41A 23/52; F41A 23/34
USPC ..... 89/37.03, 37.04, 37.02, 37.05, 37.07, 89/37.11, 40.03, 40.05, 40.06, 40.16
See application file for complete search history.

(56) References Cited

U.S. PATENT DOCUMENTS

| | | | | |
|---|---|---|---|---|
| 3,041,938 | A * | 7/1962 | Seabrook | F41A 23/16 42/99 |
| 6,042,080 | A * | 3/2000 | Shepherd | B60R 11/00 248/688 |
| 10,808,880 | B1 * | 10/2020 | Gearing | F16M 11/14 |
| 11,168,830 | B2 * | 11/2021 | Bryant | F16M 11/26 |
| 11,635,272 | B1 * | 4/2023 | Cisnero | F41A 23/10 42/94 |
| 2015/0182020 | A1 * | 7/2015 | Rahman | B60R 7/14 211/64 |

(Continued)

FOREIGN PATENT DOCUMENTS

WO 2023062346 A1 4/2023

OTHER PUBLICATIONS

International Search Report and Written Opinion received for PCT/GB2022/052557. Mailed: Dec. 23, 2022. 8 pages.

(Continued)

*Primary Examiner* — John Cooper
(74) *Attorney, Agent, or Firm* — Finch & Maloney PLLC

(57) ABSTRACT

The present invention relates to a removable weapon system, specifically to a weapons system that is magnetically engaged to a platform. There is provided a removable weapon system for a platform comprising a weapon system with a first mount, said platform comprising a second mount, said first and second mount comprising a reversible engagement device, wherein the reversible engagement device is a magnet

19 Claims, 2 Drawing Sheets

(56) References Cited

U.S. PATENT DOCUMENTS

2015/0377578 A1* 12/2015 Tucker ..... F41A 23/18
248/316.1
2016/0169607 A1* 6/2016 Rahman ..... F41A 23/02
89/37.04

OTHER PUBLICATIONS

GB Search Report under Section 17(5) received for GB Application No. 2114472.0, dated Feb. 22, 2022. 3 pages.

* cited by examiner

GUN MOUNT

FIELD

The present invention relates to a removable weapon system, specifically to a weapons system that is magnetically engaged to a platform.

Weapon systems are typically permanent installations on a platform, they are physically mounted to provide an integrated system on a hull, deck or platform.

SUMMARY

According to an aspect of the present invention, there is provided a removable weapon system for a platform which comprises said removable weapon system with a first mount, said platform comprising a second mount, said first and second mounts comprising a reversible engagement device, wherein the reversible engagement device is a magnet; preferably a switchable magnet capable in use of being switched from an energised state to an un-energised state, to allow reversible engagement.

The switchable magnet may be an electromagnet, magnetic chuck (magnetic base), switchable permanent magnet, magnet array or superconducting magnet.

The magnetic chuck, may be a permanent magnet with comprises a means of moving the magnetic field into and out of alignment, such as for example by rotation of the magnets or moving the magnets to a different alignment or away from the platform surface to reduce the magnetic field exerted on the second mount.

The magnetic chuck may have the permanent magnets moved into and out of alignment by any means, such as, for example a motor, hydraulics, manual levers.

The permanent magnets in the magnetic chuck may be aligned linearly, in rings, provided that they may be moved in and out of alignment to change the magnetic field.

Electromagnets are well known, and may provide a facile means of switching the magnetic field on and off by control of the electrical flow within the electromagnetic coil. Superconducting magnets require cooling, and may have electrical energising, in a similar fashion to electromagnets, to increase their magnetic field.

In a highly preferred arrangement the first mount on the weapons system comprises the reversible engagement device. The reversible engagement may be locked into position, by controlling the ability to switch the magnet between energised and un-energised states. This allows the weapon system to be readily located on more than one platform, and further allows the weapon system to be located in more than one location on a large platform, such that it may be dependent on where the weapon system is required, rather than having only one dedicated site.

The second mount may preferably be a non-austenitic steel, more preferably ferrous material. The second mount may be a dedicated steel plate or block or the second mount may be the platform.

The platform may be a vehicle, vessel, craft or land base. The land base may be a dock, building, installation.

Many platforms, ships, boats, land vehicles are built from ferretic steels, which allows the removable weapon system to be readily located anywhere on the platform. Preferably, the second mount is the deck, hull, chassis, loading area, of the platform, to provide flexibility of location of the removable weapon system.

The second mount may be a specifically designed receiving mount which is affixed to the platform, the where the weapons system is to be located. The receiving mount may be a flat steel plate or block of steel. The receiving mount may be required where the platform is manufactured from materials that are not attracted to magnets, such as example a composite material, aluminium or other non-ferrous metals.

The weapon system may be any system that launches or dispenses payloads, or provides a launch platform for safety or rescue equipment. The weapons system may be a gun, such as a small calibre gun 5.56 mm to 20 mm, medium calibre gun 20-40 mm, large calibre guns 60-155 mm, Remote Weapons Systems (RWS), gun systems which may comprise more than one gun of different calibres, grenade launchers, mortar tubes, torpedo launchers, countermeasure launcher, life raft launcher, situational awareness launcher. Countermeasures may be for sea, land or air, such as anti-torpedo launchers, chaff, IR, smoke devices, depth charges etc. Situational launchers may be drones, sensors etc.

In one example, a mid-sized watercraft may be required to perform different tasks, and so may be fitted with a gun on one mission. On a second mission the gun may be removed and refitted to assist in a countermeasure exercise.

In a further example a large ship may have need for a close combat role, and require means to neutralise a threat, a close-quarter small calibre gun may be retrieved from its stowed position, and located at the required position on the deck of the ship.

Where the weapon system comprises live payloads, there may be a safety interlock to prevent disengagement of the reversible engagement device of the first mount on the weapon system from the second mount, whilst the weapon system is operational. The interlock may be a physical link between the switchable magnet and the weapon system, such as for example physical interlocks, such as, for example, castell keys or the likes. The interlock may be an electronic link, which prevents operation of the switchable magnet, such as for example the fire control system or combat system may be electronically linked to the switchable magnet, to prevent deactivation of the magnet, and its attempted removal. The interlock may be a combination of physical and electronic safety interlocks.

The safety interlock may further prevent disengagement of the weapon system from the mount when there is ammunition, ie a live payload, store present in the weapon system, such as for example where a shell is loaded in the breach of said barrel. The ammunition ie shell would be required to be removed from the barrel, before the switchable magnet is capable of being deactivated, by the use of either physical and/or electronic interlocks, so as to allow appropriate safe removal of the weapon system from the platform.

The first and second mounts may comprise at least one cooperatively locating lug and void, such as to increase the surface area between the first and second mounts, thereby increasing the magnetic force exerted there between. The lug and void may co-operative interdigitated elements, stepped features etc. Preferably both the first and second mounts are substantially flat, to allow the weapon system to be located on any flat surface.

Many weapon systems require electrical power and/or data transfer between the weapon system and the associated combat system (CMS) on the platform. The power and data may be transferred between the platform and the weapon system via the first and second mounts.

The first mount may comprise a first region which comprises the switchable magnet, said first region being brought into abutment with the second mount. The first mount may comprise a second region, which comprises the mechanical devices, electrical supply, data ports for connection to the weapon system. In a preferred arrangement the weapon system may be directly fixed ie bolted to the second region. The electrical, hydraulic, data systems may be operably linked between the platform and the weapon system via the second region, or directly through the switchable magnet.

BRIEF DESCRIPTION OF THE FIGURES

Embodiments of the invention will now be described by way of example only with reference to the figures, in which:

Turning to FIG. 1, there is a weapons system 1, comprising a medium calibre gun 2, located on a first mount 3. The first mount 3 operably linked to the second mount 6, by a switchable magnet located in the second region 5 of the first mount. The first region 4 of the first mount 3 has the gun 2 directly connected on an upper surface, and further comprises the switch to activate and deactivate the magnet field. Activation of the magnetic field allows first mount 3 to remain in union with the second mount 6.

Turning to FIG. 2 shows the deck portion of a ship 20, with a deck surface 21 which is made from a ferrous metal which thereby forms the second mount 25. A weapons system 22, in the form of a medium calibre gun is secured to the first region 24 of the first mount 23. The first region 24 is operably linked to the combat system 29, which provides power, data, aiming, fire control instructions for the gun 22. The CMS 29 may also provide electrical power to activate the switch located in the first region which controls the switchable magnets (not shown) located in the second region 25.

The second region 25 is integrally linked with the first region 24, The second region comprises the magnets, and abuts and forms a mating union by magnetic force with the deck 21.

In one sequence of operation, it may require:

- Identify a vessel that requires up-gunning for the next mission.
- Remove the gun and first mount from an iso container and position it on a flat surface on the vessel e.g. helicopter decks or walkways.
- Switch on the switchable magnets to affix the gun and first mount in place.
- Connect the first mount to the ship's CMS and power source.
- Operation of the gun could be via:
  - Via a local gun control cabinet separate from the gun mount to keep the operator safe from blast and enemy fire.
  - Manually on the mount
- Upon completion of the mission the gun could simply be unplugged and the magnets could be turned off to remove the gun.

Figure 1:
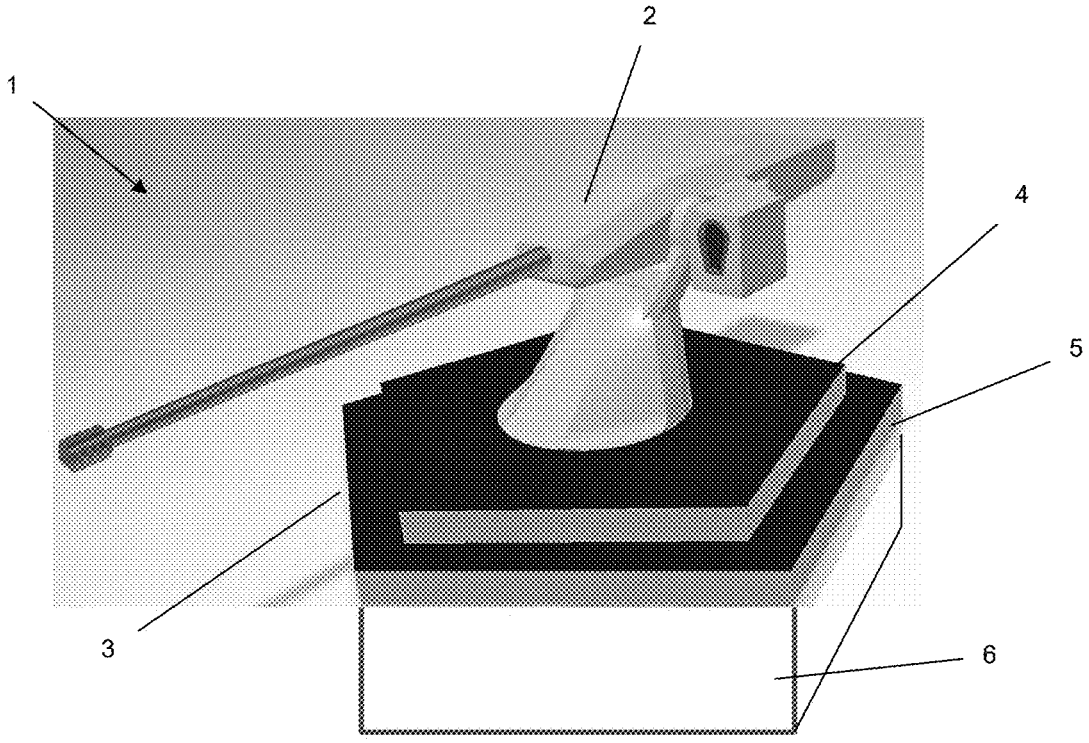
FIG. 1 shows a gun on a switchable magnetic mount . . .
Figure 2:
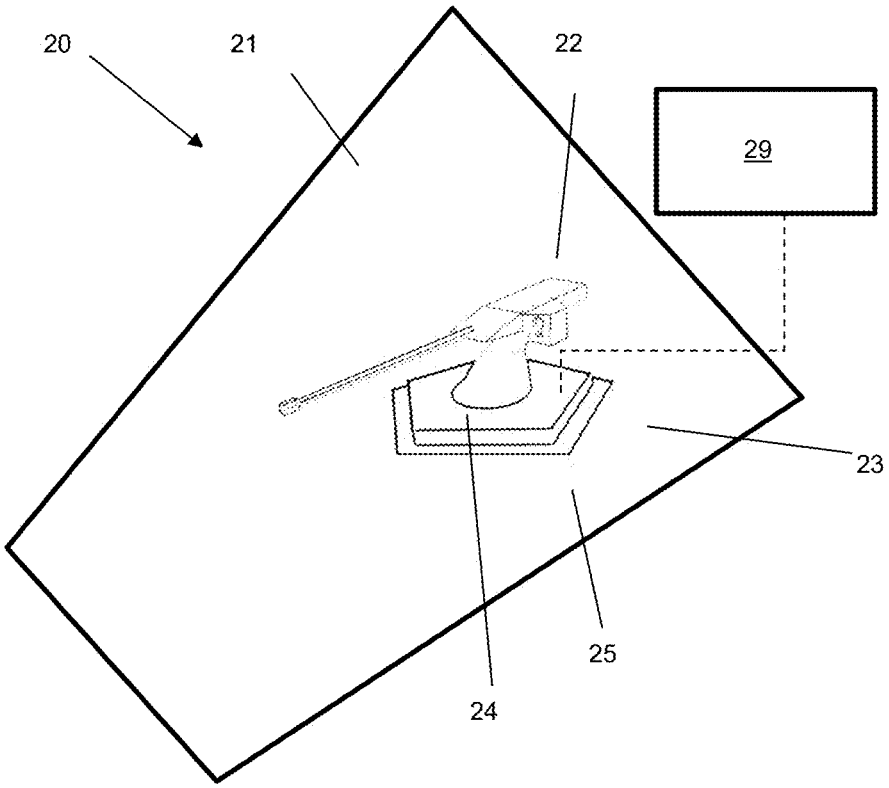
FIG. 2 shows a gun on a switchable magnetic mount attached to a deck of a boat.
Figure 3:
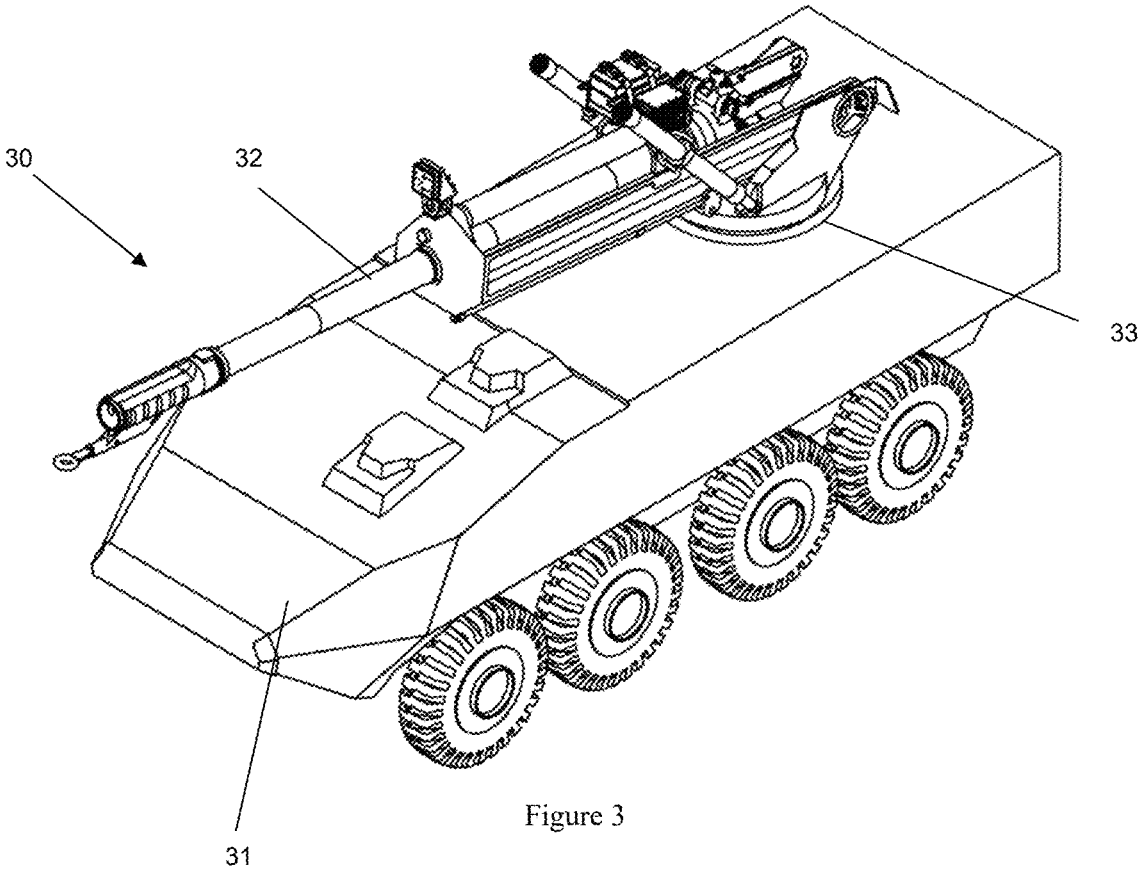
FIG. 3 shows a gun on a switchable magnetic mount attached to a road vehicle.

Turning to FIG. 3 there is provided a weapon system 30, in the form of a large caliber gun, for attachment to a platform 31 in the form of a 8×8 vehicle. The gun 32 is attached by a first mount 33 comprising the switchable magnet (not shown), to the flat body of the vehicle 31

As an example a circular base with a radius of 1.2 m would allow a retention force of up to 130 tonnes. This is 10× the maximum expected recoil load of a 40 mm cannon, therefore allowing the connection and safe operation of many common existing cannons as weapon systems that can be used with a switchable magnet in the first mount.

The invention claimed is:

1. A removable weapon system for a platform comprising a platform mount and a combat system, the removable weapon system comprising:

a weapon system with a first mount;

said first mount comprising a reversible engagement device, wherein the reversible engagement device adapted to engage with the platform mount, wherein the reversible engagement device is a magnet; and wherein the weapon system is adapted to receive electrical power and/or data from the combat system via the first mount and the platform mount.

2. The system according to claim 1, wherein the magnet is a switchable magnet capable in use of being switched from an energised state to an un-energised state, to allow reversible engagement.

3. The system according to claim 2, wherein the switchable magnet is an electromagnet, a magnetic chuck, a switchable permanent magnet, part of a magnet array, or a superconducting magnet.

4. The system according to claim 1, wherein the first mount comprises the reversible engagement device.

5. The system according to claim 1, further comprising a safety interlock to prevent disengagement of the reversible engagement device of the first mount from the platform mount, whilst the weapon system is operational.

6. The system according to claim 5, wherein the safety interlock prevents disengagement of the first mount from the platform mount when there is ammunition or payload present in the weapon system.

7. The system according to claim 1, wherein the weapon system is a medium calibre gun, a small calibre gun, a remote weapon system (RWS), a torpedo launcher, a countermeasure launcher, or a life-raft launcher.

8. The system according to claim 1, wherein the first mount and the platform mount comprises at least one cooperatively locating lug and void.

9. The system according to claim 1, wherein the second mount is a ferrous material on said platform.

10. The system according to claim 1, wherein the platform is a vehicle vessel or craft.

11. A weapon mounting system, comprising:

a first mount configured for coupling to, or part of, a weapon system;

a second mount configured for coupling to, or part of, a platform comprising a combat system;

one or more magnets in the first mount; and a switch in the second mount;

wherein the switch is controllable to switch the one or more magnets from an energised state to an un-energised state, to allow reversible engagement of the first and second mounts, and wherein the weapon system is adapted to receive electrical power and/or data from the combat system via the first mount and the second mount.

12. The system according to claim 11, wherein the switch and the one or more magnets collectively provide an electromagnet, a magnetic chuck, a switchable permanent magnet, a switchable magnet array, or a superconducting magnet.

13. The system according to claim 11, wherein the first mount includes the switch, and the second mount includes the one or more magnets.

14. The system according to claim 11, comprising a safety interlock configured to prevent disengagement of the first mount from the second mount, responsive to the weapon system being operational.

15. The system according to claim 14, wherein the safety interlock prevents disengagement of the first mount from the second mount, responsive to the weapon system being loaded with ammunition or payload.

16. The system according to claim 11, comprising the weapon system, wherein the weapon system is a medium calibre gun, a small calibre gun, a remote weapon system (RWS), a torpedo launcher, a countermeasure launcher, or a life-raft launcher.

17. The system according to claim 11, wherein the first and second mounts comprises at least one cooperatively locating lug and void.

18. A weapon mounting system, comprising:

a first mount configured for coupling to, or part of, a weapon system;

a second mount configured for coupling to, or part of, a platform comprising a combat system;

one or more switchable magnets in the first mount; and wherein the one or more switchable magnets are switchable from an energised state to an un-energised state, to allow reversible engagement of the first and second mounts; and wherein electrical power and/or data is transferrable between the platform and the weapon system via the first and second mounts.

19. The system according to claim 18, comprising a safety interlock configured to prevent disengagement of the first mount from the second mount, responsive to the weapon system being operational or loaded.

* * * * *